US005254445A

United States Patent [19]

Takamuki et al.

[11] Patent Number: 5,254,445

[45] Date of Patent: Oct. 19, 1993

[54] SILVER HALIDE PHOTOGRAPHIC LIGHT-SENSITIVE MATERIAL

[75] Inventors: Yasuhiko Takamuki; Takeshi Sampei, both of Hino, Japan

[73] Assignee: Konica Corporation, Tokyo, Japan

[21] Appl. No.: 855,620

[22] Filed: Mar. 20, 1992

[30] Foreign Application Priority Data

Mar. 26, 1991 [JP] Japan ..... 3-061930

[51] Int. Cl.[5] ..... G03C 1/81; G03C 1/85; G03C 1/30

[52] U.S. Cl. ..... 430/501; 430/527; 430/528; 430/529; 430/530; 430/621; 430/624; 430/930; 162/197; 162/271

[58] Field of Search ..... 162/197, 271; 430/527, 430/528, 529, 530, 621, 624, 501, 930

[56] References Cited

U.S. PATENT DOCUMENTS

| | | | |
|---|---|---|---|
| 3,806,574 | 4/1974 | Arvidson, Jr. | 162/197 |
| 4,141,735 | 2/1979 | Schrader et al. | 430/141 |
| 4,418,141 | 11/1983 | Kawaguchi et al. | 430/527 |
| 5,026,622 | 6/1991 | Yamada et al. | 430/527 |
| 5,098,822 | 3/1992 | Tachibana et al. | 430/527 |

FOREIGN PATENT DOCUMENTS

| | | |
|---|---|---|
| 367573 | 5/1990 | European Pat. Off. . |
| 410820 | 1/1991 | European Pat. Off. . |
| 2514352 | 10/1975 | Fed. Rep. of Germany . |

*Primary Examiner*—Charles L. Bowers, Jr.
*Assistant Examiner*—Mark F. Huff
*Attorney, Agent, or Firm*—Frishauf, Holtz, Goodman & Woodward

[57] ABSTRACT

A method of manufacturing silver halide photographic light-sensitive material with little habitual curling is disclosed. The material, after being coated with a silver halide emulsion layer and antistatic layer on the polyester support, is rolled around a core with its emulsion side facing outside, and then heated at the temperature not less than 30° C. After the heat-treatment, the material is cut and re-rolled on a commercial size core with its emulsion side facing inside.

17 Claims, No Drawings

SILVER HALIDE PHOTOGRAPHIC LIGHT-SENSITIVE MATERIAL

FIELD OF THE INVENTION

The present invention relates to a silver halide photographic light-sensitive material for film-making process, more specifically a photographic light-sensitive material for film-making process with little habitual curling.

BACKGROUND OF THE INVENTION

In the printing film-making industry, two types of films are used, namely roll films comprising a long sheet of film rolled around a core and sheet films comprising a sheet of film cut into a given size. Roll films are more commonly used because of their advantages such as easy handling and low price.

However, such roll films tend to have habitual curling due to film rolling, which poses a problem of poor handling property in sheet use, demanding improvement.

To solve the problem of habitual curling after development, some methods have been proposed, including the method of Japanese Patent Publication Open to Public Inspection (hereinafter referred to as Japanese Patent O. P. I. Publication) No. 244446/1989, which uses a film of copolymerized polyester comprising an aromatic dicarboxylic acid having a metal sulfonate. However, against the habitual curling in unprocessed films, there is no effective measure.

SUMMARY OF THE INVENTION

The object of the present invention is to provide a silver halide photographic light-sensitive material with little habitual curling in unprocessed films.

The object described above is accomplished by a silver halide photographic light-sensitive material having at least one silver halide emulsion layer and antistatic layer on the polyester support, wherein after hydrophilic colloid layer coating solutions, including a silver halide emulsion layer, are coated and dried, the film is rolled around a core (the first core) with its emulsion layer side facing outside, after which the roll film is heated at a temperature of over 30° C., cut into appropriate size, re-rolled around another core (the second core) with the emulsion layer side facing inside, and then packaged.

The amount of hydrophilic colloid layer gelatin coated on the inner side of the polyester support is preferably not more than 2.5 g/m$^2$ for both faces of the support.

DETAILED DESCRIPTION OF THE INVENTION

The present invention is hereinafter described in detail.

Although the antistatic layer for the present invention is not subject to limitation, it preferably comprises hydrophilic colloid with a metal oxide or a reaction product of a water-soluble polymer, a hydrophobic polymer latex and a hardener.

The water-soluble electroconductive polymer has at least one electroconductive group selected from sulfonic acid groups, sulfuric ester groups, quaternary ammonium salts, tertiary ammonium salts and carboxyl groups. The electroconductive group should be present at not less than 5% by weight per polymer molecule. The water-soluble electroconductive polymer may contain a hydroxyl group, amino group, epoxy group, aziridine group, active methine group, sulfinic acid group, aldehyde group and vinylsulfone group.

The number-average molecular weight of the polymer is 3000 to 100000, preferably 3500 to 50000.

Examples of water-soluble electroconductive polymer compounds include A-1 through A-21 given in Japanese Patent Application No. 16629/1990, pp. 6–11. Typical examples thereof are given below, which are not to be construed as limitative.

P-1

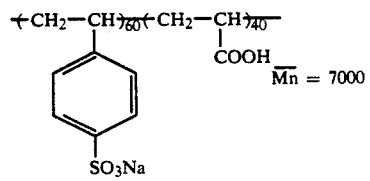

P-2

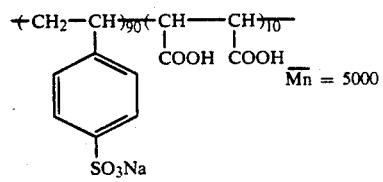

P-3

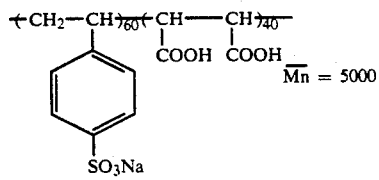

P-4

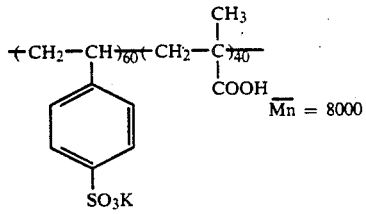

P-5

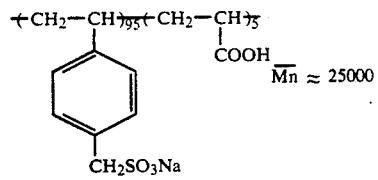

P-6

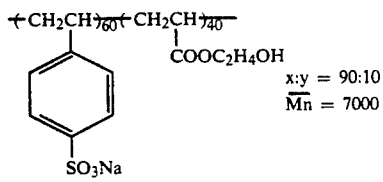

P-7

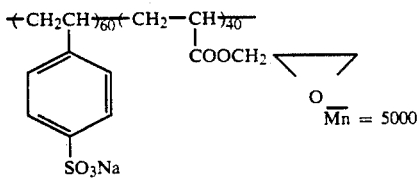

-continued

P-8

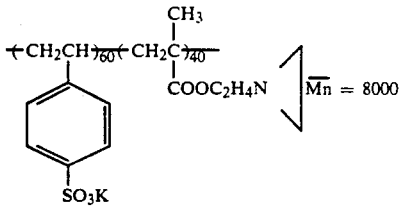

P-9

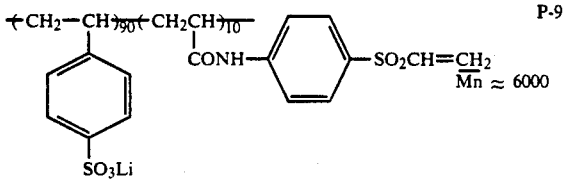

P-10

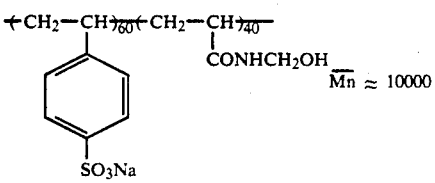

With respect to P-1 through P-10, Mn is the average molecular weight (average molecular weight means number-average molecular weight in the present specification) as determined by GPC and expressed as polyethylene glycol.

The hydrophobic polymer latex contained in the water-soluble electroconductive polymer layer is substantially insoluble in water. The hydrophobic polymer latex is obtained by polymerizing any combination of monomers selected from styrene, styrene derivatives, alkyl acrylates, alkyl methacrylates, olefin derivatives, halogenated ethylene derivatives, vinyl ester derivatives and acrylonitrile, with preference given to those containing at least 30 mol %, more preferably not less than 50 mol % of a styrene derivative, alkyl acrylate or alkyl methacrylate.

Examples of such hydrophobic latexes include L-1 through L-26 given in Japanese Patent Application No. 146629/1990, pp. 13–19. Typical examples thereof are given below.

L-1

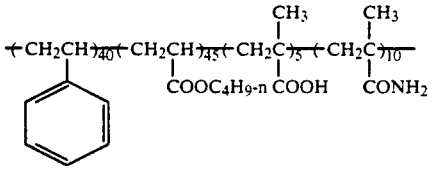

L-2

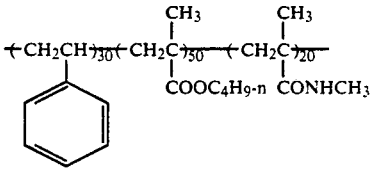

L-3

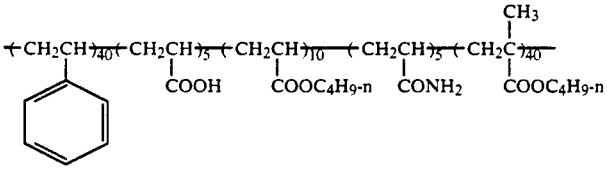

L-4

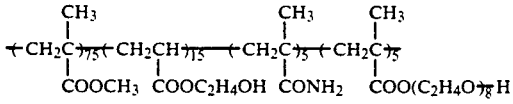

L-5

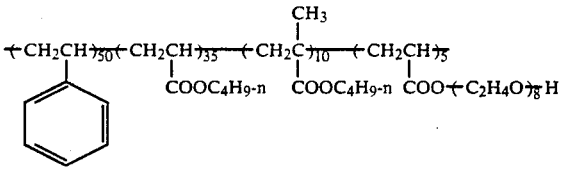

L-6

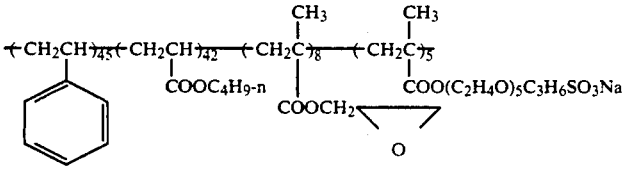

L-7

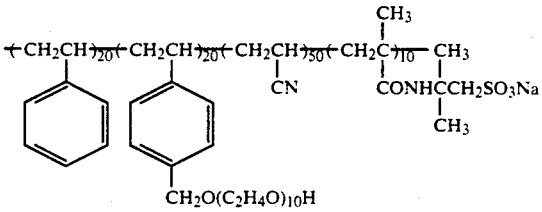

-continued

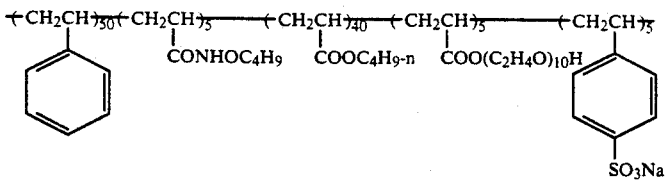

L-8

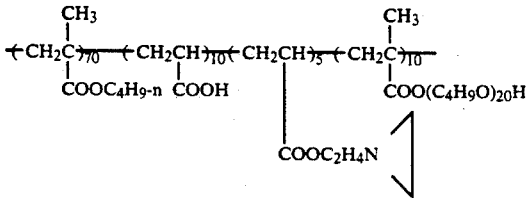

L-9

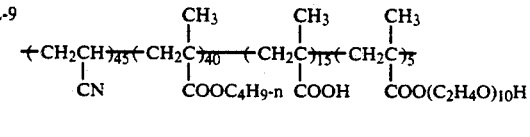

L-10

As a hardner, it is preferable to use an epoxy compound.

Any epoxy hardener can be used with no limitation, as long as it has an epoxy group. It can be used in combination with one or more other hardeners such as aldehyde hardeners and vinylsulfone hardeners.

The epoxy compound preferably contains a hydroxyl group or ether condensation linkage. In the present invention, epoxy equivalence is obtained by the following equation.

Epoxy equivalence=molecular weight/number of epoxy groups in one molecule. This value can also be obtained colorimetrically by the method described in "Shin Jikken Kagaku Koza, Vol. 13 (1), Yuki Kozo", p. 58, published by Maruzen.

The epoxy equivalence is preferably 50 to 300, more preferably 80 to 210. Epoxy equivalence values exceeding 300 result in insufficient hardening; coatability decreases as the amount increases. Insufficient hardening tends to lead to scratches. Epoxy equivalence values under 50 offer strong hardening but result in haze and residual color deterioration; no improvement is obtained even when the amount is reduced.

Examples of epoxy compounds include E-1 through E-11 given in Japanese Patent Application No. 146629/1990. Typical examples thereof are given below.

Figures in parentheses are values for epoxy equivalence.

| | Epoxy equivalence |
|---|---|
| E-1 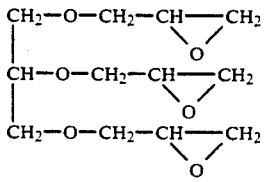 | (83.3) |
| E-2 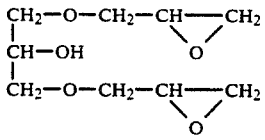 | (102) |
| E-3 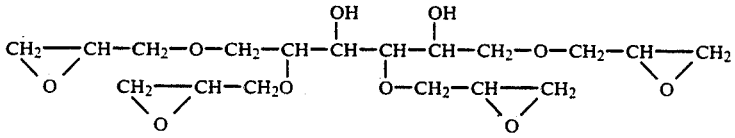 | (101.5) |
| E-4 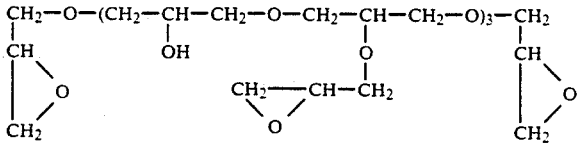 | (148) |

-continued

| | Epoxy equivalence |
|---|---|
| E-5 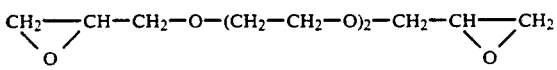 | (109) |
| E-6 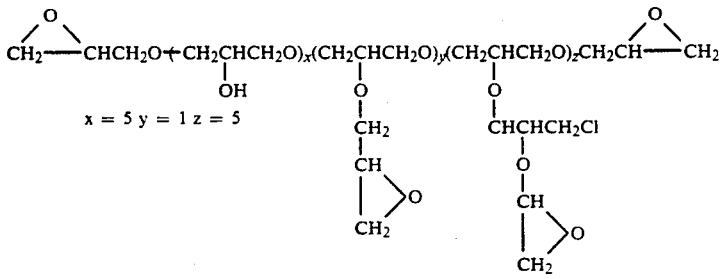 x = 5 y = 1 z = 5 | (196) |
| E-7 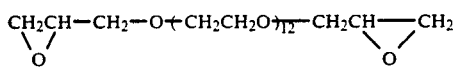 | (329) |
| E-8 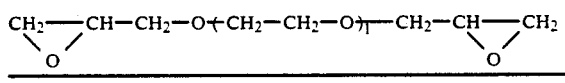 | (100) |

The amount of epoxy hardener added is preferably 5 mg/m$^2$ to 1 g/m$^2$.

The above mentioned epoxy compounds are used not only in the antistatic layer but also in an under layer, an emulsion layer, a backing layer, or a protective layer. The epoxy compound is preferably used in the hydrophilic colloid layer in contact with the antistatic layer, as this ameliorates the adhesive property.

The metal oxide for the antistatic layer may be indium oxide, tin oxide, vanadium oxide or a metal oxide doped with antimony atom or silver atom, or any combination thereof.

Two types of indium oxide, namely indous oxide $In_2O$ and indic oxide $In_2O_3$ are known, but it is preferable to use indic oxide for the present invention.

Two types of tin oxide, namely stannous oxide SnO and stannic oxide $SnO_2$ are known, but it is preferable to use stannic oxide for the present invention. As a vanadium oxide, it is preferable to use a vanadium pentaoxide. Examples of metal oxides doped with antimony atom include tin oxide and iridium oxide and with silver atom, vanadium penta-oxided. To dope these metal oxides with antimony or silver, a halide, alkoxy derivative or nitrate of tin or indium or vanadium and a halide, alkoxy derivative or nitrate of antimony or silver are mixed, oxidized and burnt. These metal compounds are easily available from metal compound manufacturers such as Nippon Yttrium Co., Ltd. The doping antimony or silver content is preferably 0.5 to 10% by weight of tin or indium or vanadium. These inorganic compounds are added preferably in dispersion in a hydrophilic colloid such as gelatin or in a polymeric compound such as acrylic acid or maleic acid. The amount of their addition per binder is preferably 1 to 100% by weight.

The film surface pH of the electroconductive layer for the present invention is preferably not more than 8.0, more preferably 3.0 to 7.5. Too low film surface pH values are undesirable from the viewpoint of film stability.

The electroconductive layer for the present invention may be on the support side with respect to the light-sensitive layer or on the opposite side of the support.

According to the present invention, the film is rolled around a core (the first core) with the emulsion layer side facing outside after coating and drying, which core preferably has an outside diameter of 100 to 500 mm from the viewpoint of the effect and productivity.

The rolled film is then cut into given size, 250 mm ~ 700 mm and wound onto a core, 50 mm ~ 100 mm, facing the emulsion layer inside and packaged. The heat treatment for the present invention is conducted before this cutting. Although heating temperature should be over 30° C. to obtain the satisfactory effect, it is preferably in the range from 34° C. to 55° C.

Although varying depending on temperature, heat treatment time is preferably not less than about 12 hours when the temperature is 40° C. Heat treatment humidity is not more than 1% as of absolute humidity. Absolute air humidity is defined as the weight ratio of water vapor and air; for example, 1% absolute humidity is equivalent to a relative humidity of about 50% RH at 29° C. or about 21% RH at 40° C.

According to the present invention, the polyester support is coated with hydrophilic colloid layers, including at least one silver halide emulsion layer, on both faces. The amount of binder gelatin coated, including all gelatin used in each face, is preferably not more than 2.5 g/m$^2$ in total for each face.

When using the silver halide photographic light-sensitive material of the present invention for film-making process, it is preferable to obtain images with very high contrast. For this purpose, it is preferable to add a tetrazolium compound or hydrazine compound to at least one layer on the emulsion layer side.

Examples of tetrazolium compounds include those represented by Formula I in Japanese Patent Application No. 107056/1990. Examples of tetrazolium compounds which are preferably used include I-1 through I-27 given on Table 1 in the same patent application, page 9.

Examples of hydrazine compounds include those represented by Formulas A and B in Japanese Patent Application No. 234203/1990. Examples of tetrazolium compounds which are preferably used include 1 through 177 in the same patent application, pp. 12–48.

The effect of the present invention can be enhanced by bringing into contact the hydrophilic colloid layer solution, including a silver halide emulsion layer, with 35° to 80° C. air for a period from 5 seconds to 1 minute within 5 minutes after the average surface temperature of the coating layer has reached the level 1° C. below the average temperature of ambient air for drying. The effect of the present invention can be enhanced by adjusting step, i.e, by bringing into contact the hydrophilic colloid layer solution, including a silver halide emulsion layer, with 35° to 80° C. air for a period from 5 seconds to 1 minute within 5 minutes after the average surface temperature of the coating layer has reached the level 1° C. below the average temperature of ambient air for drying.

After the finish of the above process, the film must be wound up onto the core within 5 minutes. It is not necessarily wound up the emulsion side facing outside, as it can be re-wound the emulsion side facing outside just before the heat treatment, however, the heat treatment must be done as early as possible but not later than 30 days from the date of the adjusting step.

EXAMPLES

The present invention is hereinafter described in more detail by means of the following examples, but the invention is never limited thereby.

EXAMPLE 1

Preparation of Antistatic Layer

(1) Polymeric Antistatic Layer (Po)

After corona discharge at an energy intensity of 10 W/(m$^2$.min), polyethylene terephthalate, previously subbed with vinylidene chloride, was again subjected to corona discharge at an energy intensity of 10 W/(m$^2$.min), and then coated with an antistatic layer coating solution with the following composition.

| | |
|---|---|
| Water-soluble electroconductive polymer P-3 | 2.5 g/m$^2$ |
| Hydrophobic latex L-3 | 1.7 g/m$^2$ |
| Ammonium sulfate | 20 mg/m$^2$ |
| Hardener-I E-6 | 500 mg/m$^2$ |
| Hardener-II E-2 | 200 mg/m$^2$ |
| Polyethylene glycol | 5 mg/m$^2$ |

(2) Metal Oxide Antistatic Layer (M)

A metal oxide antistatic layer coating solution with the following composition was coated in the same manner as with the polymeric antistatic layer.

| | |
|---|---|
| Gelatin | 0.2 g/m$^2$ |
| Styrene-maleic acid copolymer | 50 mg/m$^2$ |
| Polyethylene glycol | 2 mg/m$^2$ |
| Metal oxide (antimony-doped tin oxide) | 0.1 g/m$^2$ |
| Hardener E-7 | 50 mg/m$^2$ |

Preparation of Emulsion

A silver chlorobromide emulsion having a silver bromide content of 2 mol % was prepared as follows.

A gelatin solution containing 20 mg of rhodium sodium hexabromide, sodium chloride and potassium bromide per 60 g of silver nitrate and an aqueous solution of silver nitrate were mixed and stirred by the double jet method at 40° C. for 25 minutes to yield a silver chlorobromide emulsion having an average grain size of 0.2 μm.

To this emulsion was added 180 mg of 6-methyl-4-hydroxy-1,3,3a,7-tetrazaindene, followed by washing and desalting by conventional methods.

Then, after adding 20 mg of 6-methyl-4-hydroxy-1,3,3a,7-tetrazaindene, the emulsion was subjected to sulfur sensitization and subsequently diluted with water to yield 300 ml of a finished emulsion.

Coating of Silver Halide Emulsion Layer

To the emulsion thus obtained, the following additives were added to the following amounts of coating. After subbing with poly(styrene-butyl acrylate-glycidyl methacrylate) latex, the side opposite to the antistatic layer of the polyethylene terephthalate support was coated with the emulsion.

| | |
|---|---|
| Latex polymer: Styrene-butyl acrylate-acrylic acid terpolymer | 1.0 g/m$^2$ |
| Tetraphenylphosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 150 mg/m$^2$ |
| Phenidone | 100 mg/m$^2$ |
| Sodium styrenesulfonate-maleic acid polymer (Mw = 250000) | 150 mg/m$^2$ |
| Butyl gallate | 500 mg/m$^2$ |
| 5-methylbenzotriazole | 30 mg/m$^2$ |
| 2-mercaptobenzimidazole-5-sulfonic acid | 30 mg/m$^2$ |
| Inert ossein gelatin (isoelectric point 4.9) | See Table 1 |
| Silver | 2.8 g/m$^2$ |
| Tetrazolium compound | 50 mg/m$^2$ |

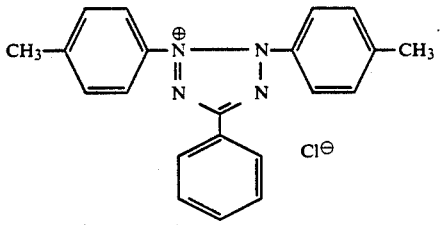

Emulsion Layer Protective Layer

An emulsion layer protective layer was coated to have the following coating amounts.

| | |
|---|---|
| Fluorinated dioctyl sulfosuccinate | 300 mg/m$^2$ |
| Matting agent: Methyl polymethacrylate (average grain size 3.5 μm) | 100 mg/m$^2$ |
| Gelatin | See Table 1 |
| Amorphous silica (average grain size 4.0 μm) | 50 mg/m$^2$ |
| Sodium styrenesulfonate-maleic acid copolymer | 100 mg/m$^2$ |

-continued

Dye 30 mg/m²

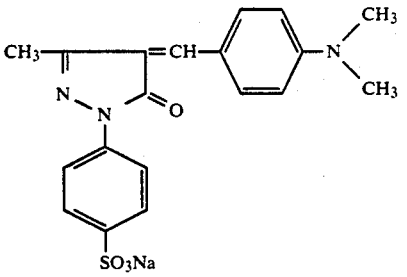

With the following hardeners, emulsion layers or protective layer were hardened.

Backing Coat and Backing Coat Protective Layer

After corona discharge at an energy intensity of 25 W/(m².min) on the antistatic layer side (opposite to the emulsion layer) of the support, a backing coat containing a backing dye with the following composition and a backing coat protective layer were coated.

| Backing coat | |
|---|---|
| Hydroquinone | 50 mg/m² |
| Phenidone | 10 mg/m² |
| Latex polymer: Butyl acrylate-styrene copolymer | 500 mg/m² |
| Styrene-maleic acid copolymer | 100 mg/m² |
| Citric acid | 40 mg/m² |
| Benzotriazole | 100 mg/m² |
| Styrenesulfonic acid-maleic acid copolymer | 100 mg/m² |
| Lithium nitrate | 30 mg/m² |
| Backing dyes a, b, c, d, e | |
| (a) | 40 mg/m² |

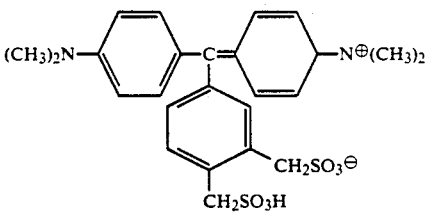

(b) 30 mg/m²

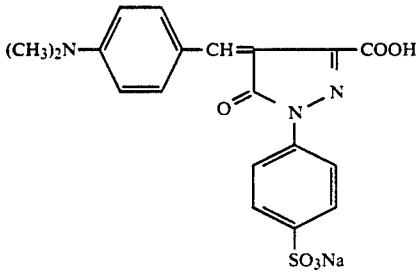

(c) 30 mg/m²

-continued

Backing coat

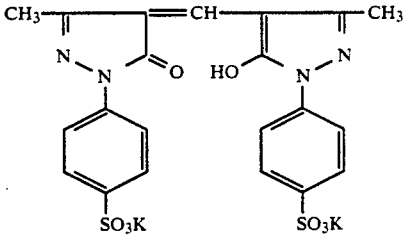

(d) 50 mg/m²

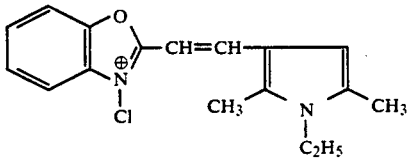

(e) 20 mg/m²

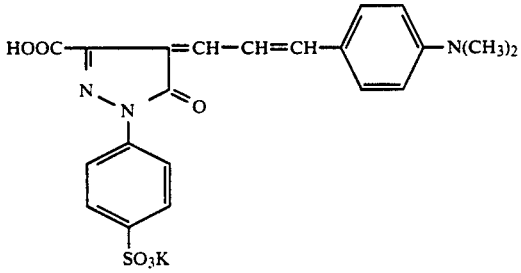

| | |
|---|---|
| Ossein gelatin | See Table 1 |
| Glyoxal | 100 mg/m² |
| Epoxy hardener (E-8) | 50 mg/m² |

The coating solution was previously adjusted to a pH of 5.4 before coating.

Backing Coat Protective Layer

After adding additives to have the following amounts of coating, the coating solution was coated on the upper face of the backing coat by the double jet method.

| | |
|---|---|
| Dioctyl sulfosuccinate | 200 mg/m² |
| Matting agent: Polymethyl methacrylate (average grain size 4.0 μm) | 50 mg/m² |
| Alkali-treated gelatin (isoelectric point 4.9) | See Table 1 |
| Fluorinated sodium dodecylbenzenesulfonate | 50 mg/m² |
| Bis(vinylsulfonylmethyl) ether | 20 mg/m² |

After coating the emulsion layer, emulsion layer protective layer, backing coat and backing coat protective layer (coating solution temperature 35° C.), the film was treated with 5° C. cold air for 6 seconds to cool and set, followed by drying to reach a water content of 1600 in the coating layer gelatin at a coating surface temperature of 10° C. using drying air having a dry bulb temperature of 23° C. and a relative humidity of 20%, followed by drying using drying air having a dry bulb temperature of 27° C. and a relative humidity of 20%, followed by drying to reach an average temperature of 33° C. on the coating drying surface using drying air having a dry bulb temperature of 34° C. and a relative humidity of 43%. After 5 seconds, the film was treated with drying air having a dry bulb temperature of 60° C. and a relative humidity of 5% with a heat conduction coefficient of 100 Kcal/($m^2$.hr.° C.) for 40 seconds.

Then, within 5 minutes the film was rolled around a core having an outside diameter of 200 mm with the emulsion layer side facing outside and was heat treated 3 days after. Then, after heat treatment under the conditions shown in Table 1, and further 3 days after, the roll was cut into given size and then rolled around another core having an outside diameter of 76.5 mm with the emulsion layer side facing inside, at 23° C., 50% RH and then packaged.

Evaluation of Habitual Curling

The roll film thus obtained was stored at 25° C. temperature and 50% relative humidity for 30 days, cut into sheets having a length of 300 mm. Under conditions of 25° C. temperature and 50% relative humidity, the curvature of the cut film as measured.

TABLE 1

| | *1 Amount ($g/m^2$) of gelatin coated on the emulsion layer side | *2 Amount ($g/m^2$) of gelatin coated on the backing coat side | Heat treatment | | | | Habitual curling | |
|---|---|---|---|---|---|---|---|---|
| | | | Antistatic layer | Temperature (°C.) | Absolute humidity (%) | Time (hr) | Curvature ($m^{-1}$) | |
| 1 | 2.7 | 3.0 | Po | — | — | — | 10.0 | Comparative |
| 2 | 2.7 | 3.0 | M | — | — | — | 9.5 | Comparative |
| 3 | 2.3 | 2.4 | Po | — | — | — | 9.5 | Comparative |
| 4 | 2.3 | 2.4 | M | — | — | — | 9.5 | Comparative |
| 5 | 2.7 | 3.0 | Po | 36 | 0.9 | 48 | 6.0 | Inventive |
| 6 | 2.7 | 3.0 | Po | 40 | 1.0 | 24 | 6.0 | Inventive |
| 7 | 2.7 | 3.0 | M | 36 | 0.9 | 48 | 5.5 | Inventive |
| 8 | 2.3 | 2.4 | Po | 36 | 0.9 | 48 | 4.0 | Inventive |
| 9 | 2.3 | 2.4 | Po | 40 | 1.0 | 24 | 4.0 | Inventive |
| 10 | 2.3 | 2.4 | M | 36 | 1.0 | 48 | 4.0 | Inventive |

*1: Expressed as total value for the emulsion layer and emulsion layer protective layer.
*2: Expressed as total value for the backing coat and backing coat protective layer.

From the results shown in Table 1, it is evident that the samples in accordance with the present invention have a small curvature and are hence good in the suppression of habitual curling. Sample Nos. 8 through 10, wherein the amount of gelatin coated was not more than 2.5 $g/m^2$, were especially good in the suppression of habitual curling.

The present invention provides a silver halide photographic light-sensitive material with little habitual curling especially in unprocessed films.

What is claimed is:

1. A method of manufacturing a silver halide photographic light-sensitive material, the material comprising a polyester support carrying a silver halide layer and an antistatic layer; the method comprising steps of:

(a) coating the silver halide layer and the antistatic layer onto the polyester support, (b) drying the coated layers to complete a light sensitive film, thereafter (c) winding the film onto a first core, the silver halide layer coated side facing outwardly, (d) heating the wound film at a temperature of 30° C. to 55° C. and at an absolute humidity of not more than 1%, for not less than 12 hours, thereafter (e) removing the film from the first core and cutting the film, and thereafter (f) winding the cut film onto a second core, the silver halide layer coated side facing inwardly.

2. The method of claim 1, wherein the temperature is 34° C. to 55° C.

3. The method of claim 1, wherein the silver halide layer is a hydrophilic colloidal layer.

4. The method of claim 1, wherein the antistatic layer is a hydrophilic colloidal layer containing a metal oxide, or a reaction product of a water-soluble electroconductive polymer, a hydrophobic polymer latex and a hardner.

5. The method of claim 4 wherein the water-soluble electroconductive polymer contains a sulfonic acid group, a sulfuric ester group, a quaternary ammonium group, a tertiary ammonium group or a carboxyl group.

6. The method of claim 1, 5 or 6, wherein the steps of the coating the hydrophilic layers and the drying the coated layers are followed by an adjusting step for contact with an air of 35° to 80° C. for 5 to 60 minutes at a timing of when a surface temperature of the layers reach one degree lower in centigrade of the temperature of a drying air.

7. The method of claim 6, wherein within 5 minutes after the adjusting step, the film must be taken up by the first core, and the heating step must be done within 30 days.

8. The method of claim 4, wherein the hydrophobic polymer latex is a styrene, a styrene derivative, an alkyl acrylate, an alkyl methaacrylate, an olefin derivative or an acrylonitrile.

9. The method of claim 4, wherein the hardner is an epoxy compound.

10. The method of claim 9, wherein the epoxy compound contains a hydroxyl group or an ether condensation linkage.

11. The method of claim 10, wherein an epoxy equivalence is 50 to 300.

12. The method of claim 11, wherein the epoxy equivalence is 80 to 210.

13. The method of claim 9, wherein an amount of the epoxy compound is 5 $mg/m^2$ to 1 $g/m^2$.

14. The method of claim 4, wherein the metal oxide is an indium oxide, vanadium penta oxide, a tin oxide or a metal oxide doped with an antimony atom or a silver atom.

15. The method of claim 1, wherein an outer diameter of the first core is 100 to 500 mm.

16. The method of claim 1, wherein a hydrophilic layer provided on a first surface of the support and a hydrophilic layer on a second surface of the support each contain gelatin in an amount not more than 2.5 $g/m^2$.

17. A silver halide light-sensitive photographic material comprising a polyester support carrying a silver halide layer and an antistatic layer produced by a method comprising steps of:

(a) coating the silver halide layer and the antistatic layer onto the polyester support, (b) drying the coated layers to complete a light sensitive film, thereafter (c) winding the film onto a first core, the silver halide layer coated side facing outwardly, (d) heating the wound film at a temperature of 30° to 55° C. and at an absolute humidity of not more than 1%, for not less than 12 hours, thereafter (e) removing the film from the first core and cutting the film, and thereafter (f) winding the cut film onto a second core, the silver halide layer coated side facing inwardly.

* * * * *